United States Patent [19]

Gergaud

[11] 4,059,737

[45] Nov. 22, 1977

[54] KEYBOARD SWITCH STRUCTURE HAVING MATRIX ARRANGED ELONGATED UNDULATED CONTACTS

[75] Inventor: Fernand Gergaud, LaGaude, France

[73] Assignee: International Business Machines Corporation, Armonk, N.Y.

[21] Appl. No.: 711,323

[22] Filed: Aug. 3, 1976

[30] Foreign Application Priority Data

Aug. 11, 1975 France ..... 75.25820

[51] Int. Cl.[2] ..... H01H 13/70

[52] U.S. Cl. ..... 200/5 A; 200/159 A; 200/275; 200/302

[58] Field of Search ..... 200/5 A, 159 R, 159 A, 200/159 B, 275, 302

[56] References Cited

U.S. PATENT DOCUMENTS

| | | | |
|---|---|---|---|
| 3,786,205 | 1/1974 | Lier | 200/159 A X |
| 3,819,882 | 6/1974 | Anderson et al. | 200/159 A X |
| 3,978,297 | 8/1976 | Lynn et al. | 200/159 B X |

FOREIGN PATENT DOCUMENTS

| | | | |
|---|---|---|---|
| 1,590,517 | 5/1970 | France | |
| 2,359,971 | 6/1975 | Germany | 200/159 A |

OTHER PUBLICATIONS

Harris, R. H.; IBM Tech. Disc. Bull.; "Positive Action Keyboard," vol. 16, No. 11; 4–1974, pp. 3714, 3715.

*Primary Examiner*—James R. Scott
*Attorney, Agent, or Firm*—Dewey J. Cunningham

[57] ABSTRACT

This invention relates to a keyboard comprising a support member, first and second sets of spaced-apart parallel conducting strips and a plurality of keys. The upper surface of the support has recesses formed therein arranged in a matrix, there being an aperture in each recess extending to the lower surface of the support. A key is adapted to fit in each recess and has a portion extending through the aperture therein. The lower surface is formed with recesses to receive the first and second sets of conducting strips which are arranged generally perpendicular to each other. Strips in the first set intersect with those in the second set, each point of intersection being generally beneath and to one side of a key. The strips of the first set are fixed in the support lower recesses. The second set of conducting strips are formed in a manner beneath each key to hold the key in its upper position when the key is at rest, and to engage a strip of the first set in a wiping action when a key is depressed. A flexible plastic material covers the upper surface of the support to hold the keys within the upper surface recesses.

3 Claims, 3 Drawing Figures

KEYBOARD SWITCH STRUCTURE HAVING MATRIX ARRANGED ELONGATED UNDULATED CONTACTS

BACKGROUND OF THE INVENTION

This invention relates to keyboards and more particularly to a type of keyboard particularly suitable for mass production.

A great number of terminals providing data to data processing systems or telephone switching systems require the use of keyboards for introducing the data. Consequently, it becomes necessary to provide the cheapest keyboards which at the same time show a sufficient quality to be reliable in all the operating conditions and give the operator a tactile response to a successful actuation of a key.

There are many keyboards available on the market. In one type, the contacts are ensured through metal diaphragms. In another type, the contacts are ensured through a metal element moving when an associated key is depressed to contact a fixed metal element provided on a printed circuit board. In such keyboards, which are generally thin, no conventional means are provided to give the operator a tactile response to a successful actuation of a key, i.e., to the closing of the associated contact.

The typical tactile response means generally include springs which are too bulky to be embodied into a thin keyboard. Consequently, attempts have been made to replace these means by elements not increasing the keyboard thickness such as the ones described in French Pat. No. 1,590,517.

The keyboard described in the above identified patent consists of a plate of flexible material provided with protrusions serving as push buttons. In a first embodiment, this plate is made from metal and is separated from a fixed printed circuit board provided with a series of metal contacts, by an insulating plate provided with holes aligned with the protrusions. When the operator depresses one of the protrusions, said protrusion is distorted and comes into contact with a contact element of the printed circuit board. When pressure is released, the protrusion comes back to its original shape with a click. Thus the operator feels that the key has been depressed and that the contact has been closed.

The keyboard according to the above-described embodiment is very simple but shows a certain number of disadvantages, namely, the metal plate is to be connected to a power source in order to have some current drawn by the fixed contact elements when the associated keys are depressed. In addition, indicia such as letters, figures or signs are to be engraved in the metal push buttons and this operation is expensive.

These disadvantages are overcome in a second type of keyboard described in the same French patent. This keyboard includes a plate of insulating material provided with protrusions used as push buttons. These protrusions are associated with moving contacts coming into contact with the fixed contact elements of a printed circuit board when pressure is applied to the push buttons.

The moving contacts are associated with the push buttons through coupling elements consisting in a preferred embodiment of small balls located under the protrusions and able to be slightly distorted.

In the two above-described embodiments, the keyboard tactile response consists in the click due to the depression of the protrusions provided in the plate of flexible material. However, in the first embodiment, the tactile response is not the best one since the protrusion has to move against the fixed contact element. In the second embodiment, this disadvantage is overcome due to the flexibility of the coupling elements, but the keyboard is much more difficult to be assembled and since it includes a high number of parts, it would be necessary to adjust the position of the various parts key by key, to ensure a good operation of said keyboard.

In addition, in both embodiments, dust can be introduced between the fixed and moving contacts or the metals can become oxidized, which prevents both elements from ensuring a good contact.

An object of this invention is to provide a keyboard which can be easily assembled without requiring any individual adjustment of the keys.

Another object of this invention is to provide a sealed keyboard in which the contacts are self-cleaned.

Another object of this invention is to provide an inexpensive keyboard with good tactile response and the capability of being shielded.

Another object of this invention is to provide a keyboard of small dimensions.

According to this invention, the keyboard includes a minimum number of parts which can be easily assembled, which allows mass production and consequently low cost.

The keyboard comprises four main elements: the keys arranged as a matrix, an insulating support, conducting contact strips and a plate of transparent insulating material. The insulating support is provided with a number of openings equal to the number of keys in the keyboard. The openings are arranged as a matrix. The individual keys are provided with printed or engraved indications such as letters, figures or signs and are housed in the openings flush with the upper surface of the support. Housings for the conducting contact strips are provided in the lower surface of the support. The strips are divided into two sets. The strips of the first set are flat and parallel and are used as fixed contact elements. The strips of the second set are parallel and perpendicular to the strips of the first set. The strips of the two sets intercross and the number of intersections is equal to the number of keys. The strips of the second set are located in the support housings and their shape is such that they hold the keys in their high position at rest. When a key is depressed by an operator, it comes to bear against the corresponding strip of the second set and this strip is brought into contact with one of the strips of the first set. The strips rub one against the other at the contact point in a wiping action and this cleans said contact point. Thus, the risks of contamination of the metals by dust deposit or oxidation are avoided.

A plate of transparent insulating material covers and is secured to the support upper surface so as to hold the keys in their openings. Cups as portions of a sphere are formed in this plate and lay in correspondence with the keys. When finger pressure is applied to one of these cups to depress the associated key, the cup goes out of shape. The cup comes back into its original shape when pressure is released, and thus a tactile response of the keyboard is obtained.

To ensure a complete tightness of the keyboard, a protective plate can be fixed to the support lower surface.

These and other objects, advantages and features of the present invention will become more readily apparent from the following specification when taken in conjunction with the drawings.

DESCRIPTION OF THE PREFERRED EMBODIMENT

Figure 1:
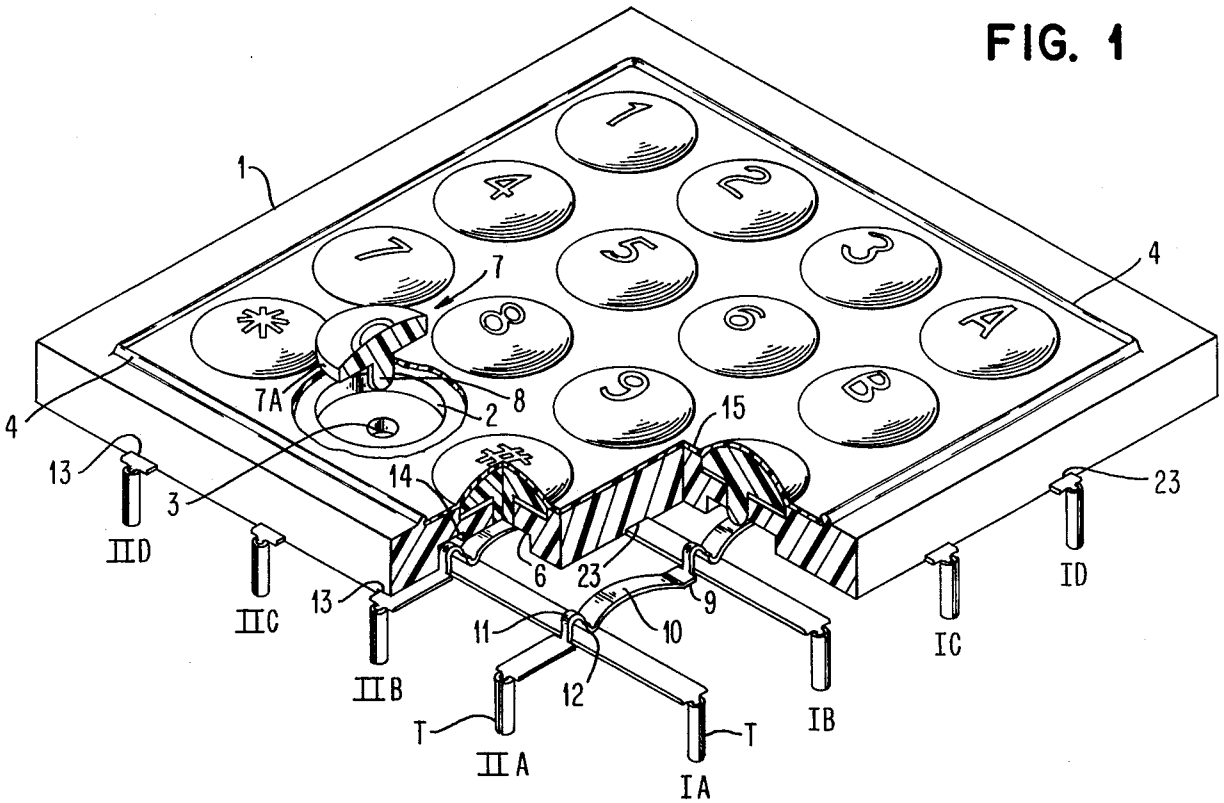
FIG. 1 shows a perspective view of a first embodiment of the keyboard of the invention with portions thereof shown in section to show the internal elements.

The keyboard shown in the drawings includes sixteen keys arranged as a matrix of four rows and four columns. It should be understood that keyboards of other configurations can be obtained from the same basic structure.

Figure 2:
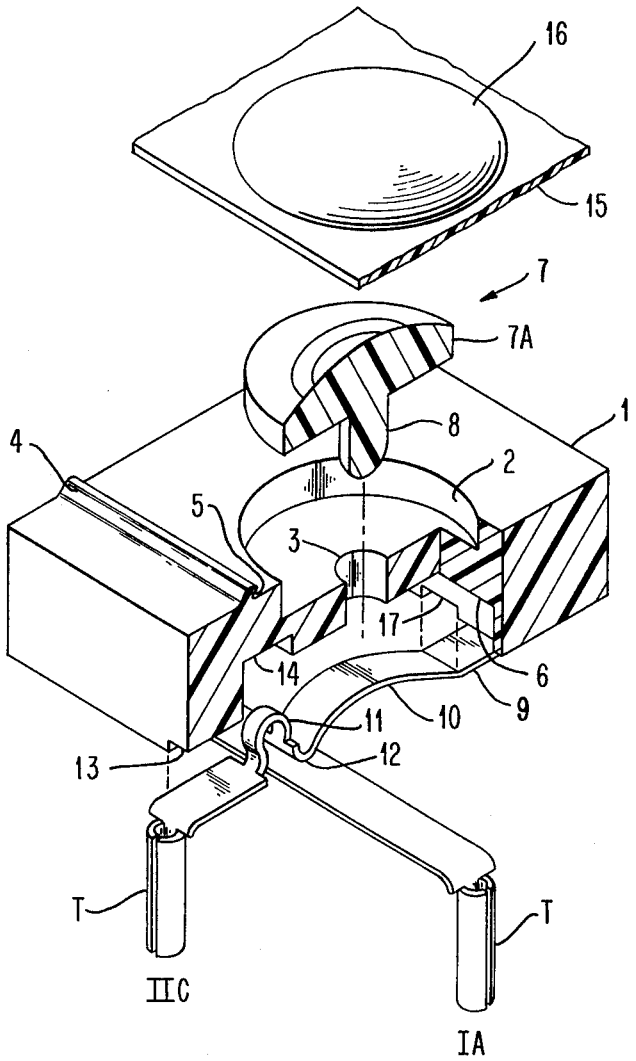
FIG. 2 is a magnified perspective exploded view of a key of the keyboard shown in FIG. 1.
Figure 3:
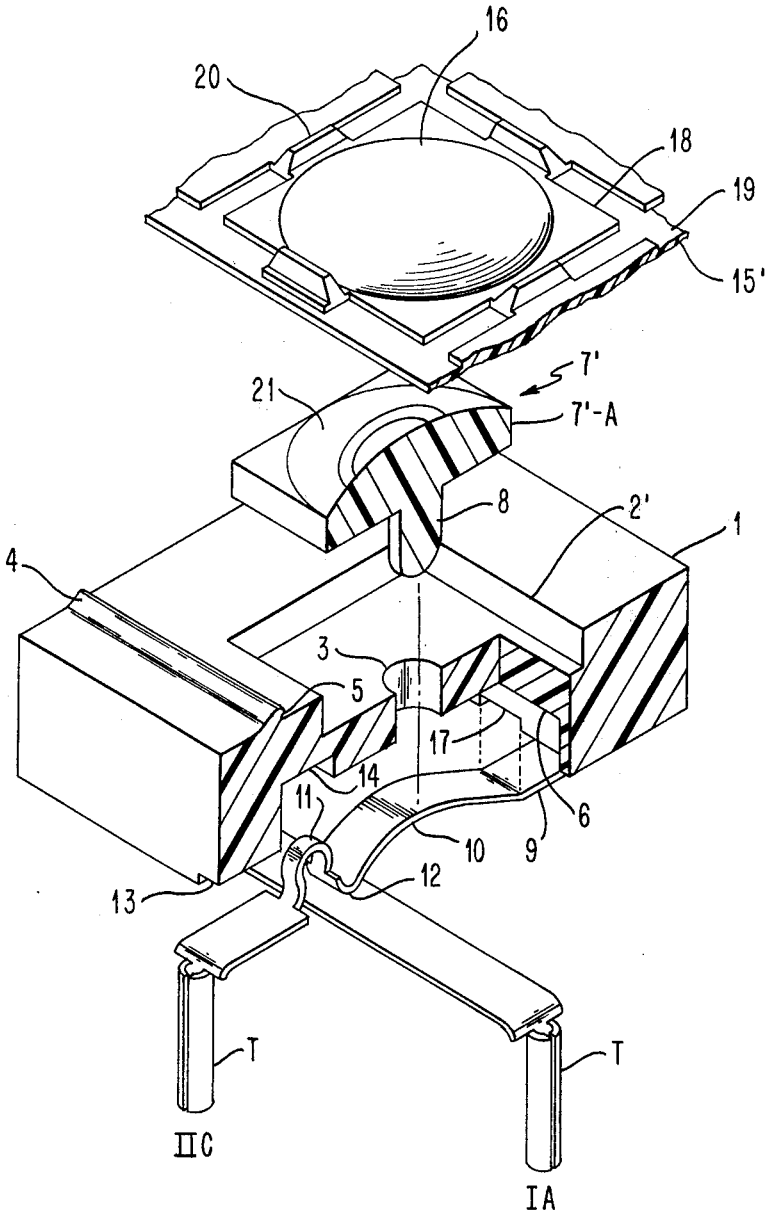
FIG. 3 is a magnified perspective exploded view of a key which can be used in another embodiment of the keyboard of the invention, with portions thereof shown in section.

The keyboard comprises a support 1 of insulating material provided with recesses 2 in its upper surface, said recesses being cylindrical in the embodiment shown in FIG. 1 and arranged as a 16-position matrix and their depth is much smaller than the overall thickness of the support. An opening 3 going through the support is provided in the center of each recess. A flange 4 with a groove 5, as best shown in FIGS. 2 and 3, is provided at the periphery of the support. The lower surface of support 1 comprises recesses 6, the shape and the function of which will be described later. Their number is equal to the number of keys.

Keys 7, with an upper push button shaped section 7A bearing such printed or engraved indications as signs, letters or figures and a rod 8, are housed in recesses 2, the rods going through the openings. The shape of upper section 7A corresponds to the shape of the recess in which it is housed, and the upper surface of each key is dome-shaped to conform to the cups in the plastic cover which will be described hereinafter.

The contact elements comprise two sets of conducting strips. The first set includes parallel stiff metal strips IA–ID. The strips are fixed into grooves 23 provided in the lower surface of the support, on the right and on the left of the keyboard. Additional grooves may be provided in the lower surface of plate 1 between the columns of keys to support and maintain the rigidity of strips IA–ID. The strips are parallel to the key rows. Each of the strips IB–ID is installed approximately halfway between two rows, strip ID being parallel to the last key row between the support edge and said row.

The second set of strips is comprised of metal strips IIA–IID, each one being of an appropriate shape as hereinafter described. They include flat sections 9, arcuate sections 10, open loops or arcuate sections 11 and contact sections 12 at the juncture between sections 10 and 11.

These strips are parallel and orientated in a direction perpendicular to the strips of the first set and installed in grooves 13 provided in the support lower surface, at the upper and lower edges of the keyboard, and aligned with openings 3. Loop sections 11 are located in grooves 14 of recesses 6. Arcuate sections 10 act as a spring blade and apply an upward force to hold the keys in the high position at rest.

The ends of both sets of metal strips are rolled and used as terminals T as shown in the drawings. These terminals allow the keyboard to be plugged into appropriate sockets or permit direction connection thereto. As is well known in the art, electrical connections are adapted to be made to both sets of strips to provide an appropriate readout of the key which is depressed.

The keys are held in position by a sheet of transparent insulating material 15 which covers all the upper surface of the keyboard and is fixed in groove 5 provided in the periphery of said keyboard. This sheet is provided with cups shaped as portions of a sphere or dome (FIG. 2) and cover the keys. The shape and thickness of said cups are such that when finger pressure is applied, the cup is flexibly distorted and the corresponding key 7 is depressed.

Now I will describe the keyboard operation. To this end, it is assumed that the contact associated to key "0" shown in FIG. 2 is to be closed. When the key is depressed, plastic cup 16 is distorted and underlying key 7 goes down. Rod 9 distorts arcuate section 10. Consequently, section 12 comes into contact with strip IA in a sliding or wiping action, thus making an electrical connection between strips IA and IIC. It will thus be seen that the radius of curvature of arcuate section 10 increases and the radius of curvature of arcuate section 11 decreases when a key is depressed. The sliding or wiping action of the strips performed when the contact closes ensures the automatic cleaning of the contact points.

Connecting loop 11 which is open on a distance approximately equal to the width of a strip enables arcuate section 10 to move laterally. On the other side, the flat section 9 which is held in fixed position by groove 17 machined or otherwise formed in the support, prevents strip IIC from coming into contact with adjacent strip IB. Thus, the closing of a particular contact does not cause the adjacent contact to close.

The distance which can be traveled by the key before coming to rest against the bottom of recess 2 is chosen so as not to unduly restrict the distortion of cup 16 in order to obtain the best tactile response.

When pressure is released, the cup takes back its original shape and also the key comes back into its initial high position under the pressure applied by flexible strip section 10.

FIG. 3 shows another embodiment of the keyboard according to this invention. Only one key is shown with respect to the first embodiment shown in FIG. 1, since only the shape of the recesses, keys and covering sheet is modified, so the design of a keyboard including this key structure is obvious and will not be described.

In FIGS. 2 and 3, the same elements bear the same references and the different elements bear the same reference with a prime sign.

A disadvantage of the keyboard with the key structure of FIG. 2 lies in the fact that with the keys close together it is possible for the operator to accidentally depress two keys at the same time.

To overcome this disadvantage, the transparent covering plate is modified as shown in FIG. 3 to provide an accurate definition of the keys.

The covering sheet is made from transparent insulating material and includes protruding squares 18 corresponding to each key and separated by recesses 19. A protruding section 20 is provided on each side of the squares. This arrangement allows the position of a key to be better defined and the operator has the tactile feel that his finger is exactly applied on a key. Cups 16 are formed in each protruding square 18.

To correspond to the shape of the covering plate, upper section 7'A of each key 7' is square and includes a protrusion 21 looking as a section of a sphere bearing a printed or engraved indication such as a figure, a letter or a sign identifying the key. Recess 2' is square and the length of its side slightly exceeds the corresponding side of section 7'A.

Now I will proceed to the description of a possible embodiment of the keyboard according to this invention.

The various parts of the keyboard are formed before being assembled. Support 1 is made of molded thermoplastic as are the keys which may be formed together as a cluster and then broken apart. The indications on the keys are printed by silk screening. The strips are made from a brass and beryllium alloy showing good resilience and conductivity. Covering sheet 15 or 15' is made from thermobonding plastic material and the cup shape is obtained by thermoforming.

When all the parts are formed, they are assembled as follows. The keys are installed in the support recesses. Then the strips are installed in the grooves provided for this purpose and then are crimped or otherwise secured at each point of support. Then the covering plate is installed on the keyboard in groove 5 and fixed to the support periphery by ultrasonic welding in several points of the keyboard upper surface. As previously indicated, the bottom of the keyboard may be covered with an appropriate sheet of thermobonding plastic material and secured to the bottom of support 1 to seal the unit from dust.

It is possible to obtain a 1cm thick keyboard in which the distance between the center of two keys is equal to 19mm.

There is described above a structure particularly suitable for keyboard mass production, but it is obvious that it is possible to make only one key by providing the structure described with reference to FIGS. 1, 2 and 3 with a single key instead of a matrix of keys.

While the invention has been particularly shown and described with reference to the preferred embodiment thereof, it will be understood by those skilled in the art that various changes in form and details may be made therein without departing from the spirit and scope of the invention.

I claim as my invention:

1. A keyboard comprising a support having in its upper surface a plurality of recesses therein arranged as a matrix and having apertures therein which extend through said support, a plurality of keys having upper portions adapted to fit in said recesses and rod portions which extend through said apertures, contact elements arranged as a matrix in the lower portion of said support comprising a first set of parallelly arranged conducting strips and a second set of parallelly arranged conducting strips generally perpendicular to said first set, a conducting strip of said first set and a conducting strip of said second set crossing each other below and laterally to one side of said rod portion of each said key, said conducting strip of said second set having a flexible arcuate portion which engages the lower end of the rod of a key and normally biases said key to its upper position and a second arcuate portion contiguous with said flexible arcuate portion, the juncture between the arcuate portions having a first position which is spaced apart from a conducting strip and a second position which is in contact with the last mentioned conducting strip, said flexible arcuate portion moving downwardly when said key is depressed thereby causing said juncture to move downwardly from one of its aforementioned positions to the other, and means for maintaining said keys in their recesses.

2. A keyboard as set forth in claim 1 in which the general radius of curvature of the first-mentioned arcuate portion is greater than that of said second arcuate portion.

3. A keyboard as set forth in claim 2 in which the radius of curvature of said first-mentioned arcuate portion increases and the radius of curvature of said second arcuate portion decreases when the key associated therewith is depressed.

* * * * *